US009058798B2

(12) United States Patent
Walker et al.

(10) Patent No.: US 9,058,798 B2
(45) Date of Patent: Jun. 16, 2015

(54) TUNABLE POLYMER-BASED SONIC STRUCTURES

(71) Applicant: University of North Texas, Denton, TX (US)

(72) Inventors: Ezekiel Walker, Denton, TX (US); Arup Neogi, Denton, TX (US); Tong Cai, Allen, TX (US)

(73) Assignee: University of North Texas, Denton, TX (US)

( * ) Notice: Subject to any disclaimer, the term of this patent is extended or adjusted under 35 U.S.C. 154(b) by 0 days.

(21) Appl. No.: 14/080,005

(22) Filed: Nov. 14, 2013

(65) Prior Publication Data

US 2014/0060960 A1 Mar. 6, 2014

Related U.S. Application Data

(63) Continuation-in-part of application No. 13/462,682, filed on May 2, 2012, now Pat. No. 8,746,398.

(60) Provisional application No. 61/481,520, filed on May 2, 2011.

(51) Int. Cl.

| | |
|---|---|
| ***G10K 11/30*** | (2006.01) |
| ***G10K 11/26*** | (2006.01) |
| ***G10K 11/00*** | (2006.01) |
| ***G10K 11/04*** | (2006.01) |
| *G10K 11/18* | (2006.01) |

(52) U.S. Cl.

CPC ..... *G10K 11/00* (2013.01); *G10K 11/04* (2013.01)

(58) Field of Classification Search

USPC ..... 181/175, 176; 381/164

See application file for complete search history.

(56) References Cited

U.S. PATENT DOCUMENTS

| | | | | |
|---|---|---|---|---|
| 4,856,107 | A * | 8/1989 | Dory | 367/150 |
| 4,970,705 | A * | 11/1990 | Stimler | 367/150 |
| 4,995,012 | A * | 2/1991 | Dory | 367/150 |
| 6,554,826 | B1 * | 4/2003 | Deardorff | 606/27 |

(Continued)

FOREIGN PATENT DOCUMENTS

JP 05027784 A * 2/1993 ..... G10K 11/30

OTHER PUBLICATIONS

Cummer, S., D. Schurig, "One path to acoustic cloaking," New Journal of Physics 9 (2007).

(Continued)

*Primary Examiner* — Edgardo San Martin
(74) *Attorney, Agent, or Firm* — Jackson Walker L.L.P.

(57) ABSTRACT

Tunable polymer-based sonic structures ("TuPSS") are made up of sonic structures and polymers. The TuPSS has three general requirements: a) The sonic structure is composed of one or materials engineered to behave as a lens, filter, cloak, or dampener; b) Stimulus sensitive polymer is incorporated into the sonic structure; and c) The actuation of the polymer tunes the acoustic behavior of the structure in a predictable manner. The tunable polymer-based sonic structures utilize stimuli-driven physical properties of the polymers in these acoustic structures to produce a stimulus driven, or tunable, sonic structure or device. The sonic structures actively modulate mechanical vibrations that propagate through the structures, but are passive in that they do not produce mechanical vibrations. The stimuli for the structures include electric, magnetic, electromagnetic, chemical, thermal, and shaking/orientation.

8 Claims, 6 Drawing Sheets

(56) References Cited

U.S. PATENT DOCUMENTS

| | | | | |
|---|---|---|---|---|
| 8,094,023 | B1 * | 1/2012 | El-Kady et al. | 340/572.1 |
| 8,557,341 | B2 * | 10/2013 | Yang et al. | 427/271 |
| 2010/0177376 | A1 * | 7/2010 | Arnold et al. | 359/307 |
| 2012/0068383 | A1 * | 3/2012 | Sinha et al. | 264/437 |
| 2012/0325747 | A1 * | 12/2012 | Rietman et al. | 210/651 |

OTHER PUBLICATIONS

Garner, B., T. Cai, S. Ghosh, Z. Hu, and A. Neogi, "Refractive index change due to volume-phase transition in polyacrylamide gel nanospheres for optoelectronics and bio-photonics," App. Phys. Exp. 2 (2009).

Goffaux, C., J. Vigneron, "Theoretical study of a tunable phononic band gap system," Physical Rev. B 64 (2001).

Hirotsu, S., I. Yamamoto, A. Matsuo, T. Okajima, H. Furukawa, T. Yamamoto, "Brillouin scattering study of the volume phase transition in poly-N-Isopropylacrylamide gels," Journal of the Physical Society of Japan 64 (1995).

Khelif, A., P. Deymier, B. Djafari-Rouhani, J. Vasseur, L. Dobrzynski, "Two-dimensional phononic crystal with tunable narrow pass band: Application to a waveguide with selective frequency," J. of App. Phys. 94 (2003).

Kushwaha, M., P. Halevi, L. Borzynski, B. Djafari-Rouhani, "Acoustic Band Structure of Periodic Elastic Composites," Physical Rev. Letters 71 (1993).

Robillard, J., O. Bou Matar, J. Vasseur, P. Deymier, M. Stippinger, A. Hladky-Hennion, Y. Pennec, B. Djafari-Rouhani, "Tunable magnetoelestic phononic crystals," App. Phys. Letters 95 (2009).

Tang, H., S. Lee, "Direct experimental verification of the sound-induced tunable resonance on a flexible electrorheological layer," Journal of App. Phys. 101 (2007).

Torrent, D., J. Sanchez-Dehesa, "Acoustic cloaking in two dimension: a feasible approach," New Journal of Physics 10 (2008).

Wang, J., X. Xu, X. Liu, G. Xu, "A tunable acoustic filter made by periodical structured materials," App. Phys. Letters 94 (2009).

Wu, L., M. Wu, L. Chien, "The narrow pass band filter of tunable 1D phononic crystals with a dielectric elastomer layer," Smart Materials and Structures 18 (2009).

Boyko, V., Richter, S., Pich, A., Arndt, K.-F., "Poly(N-vinylcaprolactam) microgels. Polymeric stabilization with poly (vinyl alcohol)," Coilloi Polym. Sci.282 (2003) 127-132.

Suk-kyun Ahn, et al. Stimuli-responsive polymer gels. Soft Matter. 2008. 4. 1151-1157.

Yu, M., Hao, X., Cui, D., Wang, Q., Xu, X., Jiang, M., "Synthesis of aluminium nitride nanocrystals and their catalytic effect on the polymerization of benzene," Nanotechnology 14 (2003) 29-32.

* cited by examiner

A)

B)

A)

B)

TUNABLE POLYMER-BASED SONIC STRUCTURES

This application is a continuation-in-part of and claims priority in part to U.S. patent application Ser. No. 13/462,682, entitled "METHODS AND DEVICES FOR ELECTROMAGNETICALLY TUNING ACOUSTIC MEDIA," filed on May 2, 2012, which claims benefit of U.S. Provisional Application No. 61/481,520 filed May 2, 2011, the entire content of each of which is hereby incorporated by reference.

BACKGROUND

This invention pertains to methods and devices for controlling the propagation of sound and particularly to tunable polymer-based sonic structures.

Propagation of sound waves through various media has been studied for centuries. Propagation of sound waves through periodic media dates back to the late 1800's and the word of Gerhard Floquet. The groundwork for understanding wave propagation in three-dimensional periodic media as it is currently understood was established by Felix Bloch in 1928. The Bloch-Floquet theorem describes how a wave can travel through a periodic medium without scattering. Using the Bloch-Floquet theorem, developments in electronics, which deal primarily with the flow of electrons through a structure, and photonics, which deals the propagation of photons through a periodic structure, were made. Especially important was the development of theories to create electronic and photonic bandgaps. The theoretical and experiment development of photonic bandgaps lead directly to the development of a theory for phononic bandgap structure.

A phonon is a quantized vibration of a material analogous to the photon being a quantized oscillation of an electromagnetic field. Sound is a vibration of air and can thus be described in phononic terms. For example, sound is an audible vibration of air, and can thus be quantified as phonons. Earthquakes are non-audible vibrations of Earth's crust, and can similarly be quantified as phonons. The vibrations felt while driving a car are vibrations of the material structure of the car and can thus be characterized and described by phonons. Any vibration of a medium, whether audible, mechanical, or otherwise can be described by a phonon. Acoustics is the generalized term used for the behavior of any type of phonon. Thus the acoustic behavior of a tuning fork would characterize the sound emitted by the tuning fork, and how it vibrates and responds to vibrations. The acoustic behavior of a bridge would characterize the response of the bridge to vibrations including what types of vibrations could cause the bridge to collapse. The dynamics of the propagation of phonons through structures can be determined by applying the appropriate version of the wave equation.

A bandgap is a range of phonon frequencies where no phonons can be transmitted through a material. A material exhibiting phononic bandgap behavior is also referred to as a phononic crystal. Whereas photonic waves possess only a transverse component, phononic waves can have both longitudinal and transverse components. Using similar techniques to those used for photonic crystal, a structure exhibiting an acoustic bandgap could be made.

Acoustic structures generally have been in existence since at least the time when humans first used ram horns as bullhorns thousands of years ago. Periodic and semiperiodic acoustic structures designed for specific purposes using phononic crystals as a basis are generally considered to have begun in the late '90s, though the underlying theory for the phononic structures stretches back to the development of the Bloch-Floquet Theorem in the late 1920s.

Tunable phononic crystals were first theoretically presented in 2003 (Khelif et al. 2003). The first tunable phononic crystal was tuned by physically changing the size of scatterers in the lattice. Tuning of a bandgap by changing the physical dimensions of the structure is difficult in practice. Physical tuning can result in unwanted defects in the lattice that would modify the bandgap or path of sound in the phononic crystal. In recent years, other methods for tuning phononic crystals have been introduced including electric (Tang and Lee 2007) or magnetic fields (Robillard et al. 2009), rotation of the crystal (Goffaux and Vigneron 2001), or by physically combining or taking apart two periodic structures (Wang et al. 2009).

Polymers with stimuli-sensitive physical properties have been studied since 1941-42 when Paul Flory and Maurice Huggins did thermodynamic entropy studies of the polymer chain orientations. From that point, hundreds of different stimuli-sensitive polymers have been designed and fabricated by numerous chemists, biologists, and physicists. The Young's modulus, density, sound velocity, and attenuation, the properties that affect the propagation of mechanical, or acoustic, waves have been sparingly studied for polymers since the early 1990's. The change in the acoustic properties of the polymer in its various phase is well know from the material stand point. Polymer based transducers have been designed, fabricated, and are available for purchase, but they are electroactive, sound producing film-like structures.

Thus, there remains a need for the development of applications of stimuli-sensitive polymers in acoustic structures and methods for tuning the polymers which does not require physical contact.

SUMMARY

The present invention relates generally to "acousto-optics," or more particularly to a material having acoustic properties that can be influenced by a variety of physical stimuli. The tunable polymer-based sonic structures utilize the stimuli-driven physical properties of the polymers in these acoustic structures to produce a stimulus driven, or tunable, sonic structure or device. The sonic structures actively modulate mechanical vibrations that propagate through the structures, but are passive in that they do not produce mechanical vibrations. The stimuli for the structures include electric, magnetic, electromagnetic, chemical, thermal, and shaking/orientation.

Because light and sound waves travel through a medium at very different frequencies and are not influenced by one another, the design of a mechanical or optoelectronic device in which the propagation of sound can be controlled by external stimuli is a significant achievement. The current methods and devices relate to materials having acoustical properties. The properties of these materials can be influenced by a variety of physical stimuli. The sound velocity travelling through the medium in the hypersonic range can be modified through modulation of its internal structure by the physical stimuli.

Sonic, or acoustic, structures are man-made composite structures that can predictably affect the propagation of acoustic/sound waves through their material composition and the physical distribution of the materials. For example, raw acrylic has no special properties with respect to sound except that it transmits most frequencies of sound. However, shaping the acrylic can cause the transmitted sound to be focused to a point to form an acoustic lens.

Structures that are composed of periodically/semi-periodically arranged materials and are designed to work with acoustic waves are termed phononic crystal structures, or phononic crystals, for short. FIG. 1 shows an image of an example of silicon phononic crystal. Two components are required of this acoustic material: an artificial solid periodic structure, and a medium with acousto-elastical properties that are responsive to stimuli. Steel on its own is usually a very good conductor of sound. However, if one were to arrange steel cylinders periodically in another material of different physical properties, air or sound for example, then some frequencies of sound would not propagate through the matrix of cylinders. Other frequencies of sound would pass through the structure with minimal modification, and some would even be focused to a point.

Both the acrylic lens and steel phononic crystal are sonic structures because they affect sound of some form, and their affects are not purely from the material properties, but from a combination of the material properties and shape/arrangement of the materials. Changing either changes the behavior of the sonic structure.

Many polymers are special in that they have physical properties that can be selectively changed through stimuli such as temperature, pH, magnetic, electric, orientation, movement, or others. Poly (acrylic acid), poly (N-isopropylacrylamide), cinnamic acid, and many other polymers have polymer chains that undergo a transition due to an external stimulus as determined by their chemistry. The polymer chains can be viewed as coils that will stretch or scrunch together dependent on their local environment.

The transition of the polymer between various bonding states causes changes in the physical properties of the polymer that may include the density, sound velocity, elasticity, and other mechanical parameters. For many of the polymers, the continuous or discontinuous volumetric or crystalline phase transitions that result from the changing states of the polymer chains result in the sudden shrinking, swelling, or precipitation of the polymer out of a solution. Since the polymer can be controllably stimulated to undergo these phase transitions that cause changes in their physical properties, they present an ideal material with tunable physical characteristics.

The present tunable polymer-based sonic structures (or "TuPSS") have physical properties that can be changed with an external stimulus. The acoustic behavior of the structures is dependent on the physical characteristics of the materials that compose the structures and the design and arrangement of said materials. The final behavior of the structures may have properties that seem counter to the individual properties of the structure (i.e.—air being a great sound transmitter, steel being a great sound transmitter, but a periodic arrangement forbidding transmission).

The TuPSS makes use of a polymer with stimuli sensitive physical properties in an acoustic/sonic structure to make a tunable sonic structure. Sonic structures consist of materials or structures that have been designed to control or manipulate propagating mechanical or acoustic vibrations through a medium. Some sonic structures attain their properties through the geometric shaping of a material or composite of materials. Periodic/semi-periodic arrangements of one or more materials in a medium, also called phononic crystals, result in structures that exhibit properties separate from the individual components that compose the phononic crystal. Phononic crystal based sonic structures utilize the periodic or semi-periodic arrangement of two or more physically differentiated materials. The result is a structure that exhibits properties separate from the individual components that compose the phononic crystal. For acoustic waves that are on the same dimension or larger than the periodicity, the crystal behaves as a singular structure.

The acoustic dynamics, or behavior of sound as it passes through the structures may be determined by the size, shape, periodic arrangement, and orientation arrangement of the scatterers, the density, longitudinal, and transverse sound velocities of the materials used in the structure, and the wavevector of the impinging acoustic wave. The periodic or semi-periodic arrangement details the spacing of scatterers. The orientation arrangement details the relationship between the orientation of a scatterer and its neighbors with respect to the impinging acoustic wave. Changing any combination of the acoustic dynamics variables will change the propagation behavior of the structure. This equates to tuning the structure.

One component of the TuPSS is the use of a polymer that has acousto-elastical properties that can be manipulated through the use of external stimuli. For the present disclosure, "polymer" will only refer to polymers with stimuli sensitive physical properties. Stimuli are preferably limited to electric, magnetic, electromagnetic, chemical, thermal, and shaking/orientation. The family of cross-linked N-isopropylacrylamide, acrylic acid, and block co-polymers all have physical properties that either respond naturally or can be engineered to respond to an external stimulus such as temperature, pH, light, mechanical vibrations, magnetic, or electric amongst others. The response can be designed to be reversible or non-reversible. In either case, the modulation of some combination of the Young's Modulus, Bulk Modulus, Sheer Modulus, viscosity, density, volume, phase, sound velocity, or crystallinity causes a change in how mechanical vibrations propagate through the polymer.

An optional component of the TuPSS is a periodic or semi-periodic structure. The artificial solid periodic/semi-periodic structure is preferably composed of two or more elastic materials. By careful consideration of the periodicity of the lattice, the shape of the scatterers in the lattice, and the contrasts in elasticity properties between the scatterers and the lattice structure, the material can be made to forbid the propagation of a select range or ranges of acoustic waves (Kushwaha et al. 1993). The variables involved in determining the acoustic dynamics include the size, shape, and arrangement of the scatterers, the density, longitudinal, and transverse sound velocities of the materials used in the structure, and the wavevector of the particular phonon.

The TuPSS is created by incorporating the polymer into the sonic structure so that the structure's properties change as the polymer is modulated by the external stimulus, whichever is most convenient for the device application. Passive acoustic devices primarily operate as some form of a lens, filter, or dampener. Any change in the physical material characteristics will change overall behavior of the TuPSS, thus making it a structure that is tuned with the external stimulus that changes the polymer.

The sonic structures may be functionalized phononic crystals. If they are functionalized PnCs, the effectiveness of the structures is limited by the effectiveness of the PnC. A PnC will only affect an acoustic wave in the direction of periodicity. This introduces a dimensionality element. A PnC with one direction of periodicity (e.g.—repeating slab-layers) will only be effective in that direction. Since there is only one direction of effectiveness, the PnC is designated as 1-D. 2-D PnCs have a plane of effectiveness, and 3-D affects acoustics in all directions. The actual acoustic effect may not be the same in all directions. However, the dimensionality still is an indicator of whether a PnC is effective in one direction, a plane, or all directions. This dimensionality is grandfathered into the TuPSS.

The sonic structure acts passively on mechanical vibrations that propagate through or very near the structure and does not produce its own vibrations. It also requires that the stimulus be activated through some means. In cases of electric tuning, an external source of E-fields that could interact with the structure would be necessary. In cases of thermal tuning, a change in the temperature of the ambient medium, the components of the structure, or the polymer itself by some means would be necessary. Some polymers can be designed to respond to impinging acoustic waves, but are generally considered more for their responsiveness to non-mechanical stimuli for the present TuPSS.

The present TuPSS has three general requirements:

a) The sonic structure is composed of one or materials engineered to behave as a lens, filter, cloak, or dampener;
b) Stimulus sensitive polymer is incorporated into the sonic structure; and
c) The actuation of the polymer tunes the acoustic behavior of the structure in a predictable manner.

The tunable polymer-based sonic structure is useful for designing an array of devices such as tunable filters, biosensing filter devices modulated with pH, cloaks in the acoustical domain for use in underwater acoustical devices and sensors, as well as sounds absorbers and filter for various auditoriums and highway, railway, or airway systems. A TuPSS can be used in any capacity where a mechanical wave must be actively modulated. Current technologies that use active acoustic modulation are ultrasonic biological imaging, sonic focusing for hyperthermic biological stimulation, geophysical mapping and subsurface imaging, active vibration dampening, and SONAR amongst other technologies. The TuPSS can also be adapted to design high resolution ultrasonic and hypersonic medical imaging systems for improving the resolution of features that can be currently detected. The use of materials responsive to external stimuli to tune the TuPSS is highly advantageous in these applications.

DETAILED DESCRIPTION OF PREFERRED EMBODIMENTS

Figure 1:
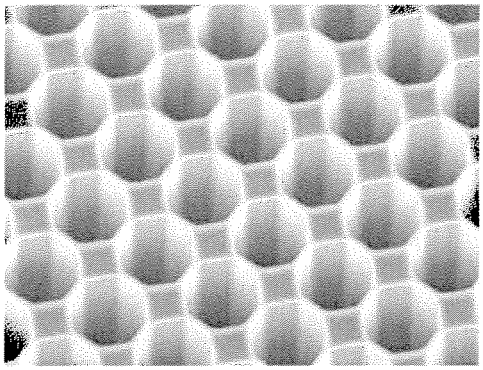
FIG. 1 shows an image of a silicon phononic crystal.

Generally, methods and devices for tuning polymer-based sonic structures ("TuPSS") are described herein. In particular, the TuPSS utilizes an induced change in the mechanical properties of a polymer that has been incorporated into a sonic structure to modulate the acoustic behavior of the sonic structure. The structure operates passively on elastic waves that interact with the structure, but is actively controlled either electrically, magnetically, electromagnetically, thermally, mechanically, or chemically.

General Concepts to Assist in Understanding the TuPSS

I. Acoustics

Time is simply defined as some unit of time that has passed and is usually divided into seconds, minutes, hours, and so on. In this text, time may be referred to by the symbol 'T'. Speed and velocity are terms that are commonly interchanged, but are distinctly different and must be distinguished. Speed is the distance traveled per unit of time. Velocity is a more general term, and refers to the speed and direction of an object or thing. Both will be referred to by 'v'. Density is the amount of matter, or mass, in a unit volume, and is represented by the Greek letter rho, 'ρ'.

The current understanding of nature is that without an outside influence in the form of a force, nature will strive to attain equilibrium. Energy will generally pass from a more energetic system to a less energetic system until both systems have roughly the same energy. This is important, as it also applies to a medium. If a medium is in an equilibrium state, and a force is induced that causes a deviation from that state, there is a force in that medium that seeks to restore its equilibrium state. The dynamics of that restoring force are heavily dependent on the properties of the medium, and, for purposes of this disclosure, are never able to restore the medium back to its equilibrium state instantaneously. Like a spring that has been stretched and released, and oscillates or vibrates until it eventually returns to its pre-stretched state, restoring forces in nature generally behave the same way. So, a disturbance in a medium causes oscillations of some form in the medium as it tries to return to equilibrium.

A wave is a disturbance within some medium that propagates with some velocity dependent on the properties of the medium (Berg, R., Stork, G., 2005). Waves represent the nature of the disturbance from which they are sourced. So a disturbance that is random or semi-random in nature will cause waves with the same properties. Disturbances that are periodic or semi-periodic will induce waves with similar properties in the medium. Wavelength and frequency are analogous and represent the time dependent periodic properties of a wave. Wavelength defines the physical distance between any two, neighboring identical oscillations, and frequency is the amount of time that passes between the same two oscillations at a stationary point. Waves are characterized by their magnitudes and wavelength/frequency. Large disturbances will create large waves, but will not necessarily affect the frequency.

Most media are defined to be physical in nature. That is, they are composed of atoms, and generally may be solid, liquid, or gas. Systems composed of matter are usually termed mechanical systems. So an oscillation in a mechanical system is termed a mechanical vibration. Waves in a mechanical system are referred to as acoustic waves, elastic waves, mechanical vibrations, or sound and can be used interchangeably. Acoustic waves, elastic waves, and sound all have periodic or semi-periodic properties. Mechanical vibrations are the most general term, but usually also have the same periodic/semi-periodic nature. Electromagnetic waves, or light, are oscillations of coupled electric and magnetic fields. Electric and magnetic fields are not mechanical systems by any definition. So, a critical difference between an electromagnetic (EM) wave and an acoustic wave is that EM waves do not require a mechanical medium for propagation, whereas acoustic waves do.

How a wave propagates through a medium is ultimately determined by the how strongly a medium will react to a disturbance, and how quickly the restoring force will be transmitted from one particle to another in that medium. The dynamics of restoring forces are represented in the elastic properties of a medium. The elastic properties include the Young's Modulus, the Bulk Modulus, and Shear Modulus. All are parameters in a material's stress tensor; details of which are not critical in the understanding of the present invention. The density and elastic properties completely determine the behavior of mechanical vibrations in a medium and will be termed together as the mechanical properties of a medium. Thus if an elastic wave travels from one medium to another, or the density or elastic properties of a material are modified, the propagation of the elastic wave will be modified.

II. Sonic Structures

A sonic structure is a combination of one or more materials with differing mechanical properties that has been designed through the geometric shaping or arrangement of the material (s) to achieve a desired effect on a set of acoustic waves. As specified in the previous paragraph, as an elastic wave travels between materials with differing mechanical properties, the propagation of the wave is directly affected. Utilizing wave theory, which is the study of wave processes, materials can be geometrically shaped or arranged to cause elastic waves to exhibit a desired behavior. The geometrically induced effects are not random, and are a direct result of the combination of the material properties and the geometric shaping/arrangement. The geometric shaping or arrangement of one or more materials to achieve a desired effect will be referred to as hylemorphing.

Reading glasses are a great example of hylemorphic light structures. Reading glasses are designed to focus and/or magnify light to compensate for a reader's vision. A random transparent piece of glass does not have the ability to focus/magnify. However, by shaping the glass in either a concave or convex manor, a lens can be formed, and light that passes through the lens can be focused to a point. The focal distance is determined by the physical properties of the glass, and the degree of curvature of the lens.

Hylemorphing for either acoustics or electromagnetics is used to accomplish focusing/defocusing, filtering, reflecting, collimating, or dampening of either acoustic or EM waves. Sonic structures are hylemorphed specifically for acoustic waves, though they may affect EM radiation as a side effect based on non-mechanical properties.

Periodic/semi-periodic arrangements of materials consist of one or more materials that are arranged in regular/semi-regular repeating patterns. A periodic/semi-periodic structure behaves as a bulk, single structure, even though it is a composition of patterned materials. These patterned structures are referred to as phononic crystals for acoustic waves, and photonic crystals for EM waves. Since both are arrangements of materials designed to achieve a specific effect, they are hylemorphic, though each is distinct in the type of wave it will affect. The acoustic behavior of the bulk structure can be readily deduced again from wave theory, and is dependent on a combination of the mechanical properties of the materials and hylemorphic properties.

Acoustic hylemorphic structures may involve periodic/semi-periodic arrangements of one or more materials that will behave as a single structure, the shaping of one or more materials geometrically, or contain a combination of the two. Returning to the definition of a sonic structure, a sonic structure is an acoustic hylemorphic structure. Sonic structures that are active will produce elastic waves and behave as acoustic sources. Passive sonic structures will only passively affect elastic waves that are not sourced from the structure, and are not acoustic sources.

A desired effect for a sonic structure may be achieved in numerous ways. The only requirements for designing a sonic structure are mechanical media (aka elastic materials), intuitive or in-depth knowledge of wave theory, and properly applied hylemorphism. The present disclosure concerns passive sonic structures.

Stand-alone acoustic structures have been around in some format since at least the first uses of ram's horns as bullhorns and musical instruments. The development of phononic crystals can be traced back to Gerhard Floquet in the late 1800's and his theorem involving wave propagation through a periodic media in one-dimension. The groundwork for understanding wave propagation in three-dimensional periodic media as currently understand was established by Felix Bloch in 1928 by unknowingly building and expanding on Floquet's work. The Bloch-Floquet describes how a wave can travel through a periodic medium without scattering.

III. Polymers

Polymers are classes of molecules that have been linked together to form long chains of the constituent molecule. In 1941-42, Paul Flory and Maurice Huggins did thermodynamic entropy studies of polymer chain orientations. In their studies, they found that the entropy of mixing with polymer chains in aqueous solutions would cause the orientation of the chains to abruptly rearrange as the entropy reached a critical point. In one state, the polymer chains would be in a relaxed, coil-like state, and upon reaching the critical point, would change to a globule-like state. The coil-globule transition causes the mechanical properties of the polymer to change as the bonding between the aqueous medium and polymer chains are rearranged.

In Flory and Huggins' studies, the entropy was determined by the temperature of the solution. Further advancements by others found that pH, polymer concentration, electric and magnetic fields, mechanical vibration, electromagnetic fields, and other stimuli could also affect the entropy of mixing and thus induce a change. Since the change is dependent on the entropy of mixing, the process is reversible. Thus the polymer represents a material with mechanical properties that can be predictably and reversibly modulated through many different means.

The field of polymer science has grown exponentially since the Flory-Huggins studies. The process of creating polymers with custom stimulus responsive and mechanical properties has become an exercise in chemistry. The techniques involved in the formulation and customization process are too numerous to detail, but are found in scientific literature. All techniques involve the manipulation of bonding, linking, and distribution characteristics of polymer chains. Not all polymers have stimulus responsive properties, so this disclosure restricts its definition of "polymers" to only include those with stimulus sensitive mechanical properties (Suk-kyun Ahn, 2008).

The mechanical properties of polymers are modulated by a stimulus. Since the propagation of acoustic waves is determined on the most fundamental level by the mechanical properties of a medium, the ability to predictably control any mechanical parameter in a material allows for the use of a tunable acoustic material. As polymers undergo the coil-globule transition, some combination of the volume, density, bulk and sheer moduli, attenuation, and sound velocity are modified in some fashion. The degree to which the mechanical properties are changed, and how the mechanical properties are changed is heavily dependent on the type of monomer used to form the polymer, how monomers are bonded together, how the polymers are linked together, and the amounts of all materials involved. Since the coil-globule transition is stimulus sensitive, polymers as used herein are tunable acoustic materials.

In preferred embodiments, then polymer used in the TuPSS is any suitable polymer that possesses stimulus sensitive mechanical properties. The following consists an incomplete list of available monomers (single link of polymer chains), and polymers (linked polymer chains) that have mechanical properties that will respond to one or more of the following stimuli: electric, magnetic, electromagnetic, chemical, thermal, shaking of the polymer.

1. Poly(ethylene oxide) with $BiFeO_3$
2. N',N-dimethylacrylamide
3. Gelatin cross-linked by ethylene glycol diglycidyl ether
4. Polysaccharide
5. BIS Bisacrylamide
6. PAA Poly(acrylic acid)
7. PAAEM Poly(acetoacetoxyethyl methacrylate) with $FeO_2$
8. PAm Poly(acryalamides)
9. PBA Poly(butyl acrylate)
10. PDEA Poly[2-(diethylamino)ethylmethacrylate]
11. PDMS Poly(dimethylsiloxane)
12. PDPA Poly[2-(diisopropylamino)ethylmethacrylate]
13. PEO Poly(ethylene oxide)
14. PGMA Poly(glycerol monomethacrylate)
15. PHEMA Poly(hexyl ethyl methacrylate)
16. PHFBMA Poly(hexafluorobutylmethacrylamide)
17. PLG Poly(glutamic acid)
18. PLLA Poly(L-lactides)
19. PMMA Poly(methyl)methacrylate
20. PMPC Poly[2-(methacryloyloxy)ethylphosphorylcholine]
21. PNaA Poly(sodium acrylate)
22. PNaVBA Poly(sodium-4-vinylbenzoate)
23. PNCL Poly(N-vinylcaprolactone)
24. PNIPAM Poly(N-isopropylacrylamide)
25. PPO Poly(propylene oxide)
26. PSMA Poly(stearyl methacrylate)
27. PVIm Poly(N-vinylimidazole)
28. Poly (Vinyl Alcohol) with $BaTiO_3$
29. Poly(N-vinylcaprolactam) microgels with AlN nanocrystals Tunable Polymer-Based Sonic Structures (TuPSS)

A Tunable Polymer-based Sonic Structure (TuPSS) is a hylemorphic acoustic structure that incorporates one or more polymer materials. The bulk behavior of a sonic structure is dependent on the component materials' mechanical and hylemorphic properties. With the incorporation of polymers, a stimulus will induce a change in the mechanical properties of a component material of the structure, and may, for polymers that undergo volumetric changes, even affect the hylemorphic properties. Thus applying a stimulus to a TuPSS will affect the dynamics of a propagating elastic wave; tuning the structure.

Stimuli for TuPSS include electric, magnetic, electromagnetic, chemical, thermal, and shaking of the structure. The effective stimuli will only be those which induce changes in the mechanical properties of the incorporated polymer(s). TuPSS, by definition in this disclosure, is a passive device that is actively tuned. So it is an active, passive device. The uniqueness of the TuPSS is in the incorporation of one or more polymers with stimulus sensitive mechanical properties into a sonic structure to enable tunability as a result of changes in the mechanical or hylemorphic properties of the structure, where the stimuli are either electric, magnetic, electromagnetic, chemical, thermal, or shaking of the structure.

A well-known active, passive electromagnetic device is a transition lens. Transition lenses are known for their ability to darken when in sunlight, yet remain clear when not exposed to sunlight. It is passive in the sense that it does not produce any electromagnetic waves. However, it is active in the sense that it changes with response to a stimulus. It is should be noted that transitions are EM structures, and changing the tint on glasses will have a negligible effect on any type of elastic wave. TuPSS operates similarly, only it affects mechanical vibrations, not electromagnetic waves.

Current active acoustic technologies have three primary limitations: expensive complicated electronics to coordinate arrays of transducers, focal length limitations to the near-field of focused frequency, limited or very selective frequency operation ranges. TuPSS requires design parameters to manipulate the mechanical vibrations in predictable manner as a stimulus is applied, but only requires the external stimulus to operate within its design.

Limitations for active sonic or ultrasonic focusing are derived from the limitations of coherent constructive acoustic interference to the near-field as determined by the wavelength to be focused. TuPSS acts passively on propagating waves, analogous to an optical lens focusing light. Just as lenses can be designed to focus to, theoretically, any length, TuPSS can also be designed to focus to any length and work in a broad or selective frequency range. Unlike a standard optical lens, with properties that are fixed, the TuPSS can be modulated such the acoustic lens will focus/defocus or change the focal length. In short, TuPSS is superior to current focusing technology in that is does not require expensive electronics to coordinate many components, can focus to, theoretically, any length, and can be tailored to work over a broad or narrow frequency range.

The use of polymers in an acoustic structure is also a unique idea. The combination of polymer with a sonic structure allows for the active modulation of the sonic structure using an external stimulus. The sonic structure modulates mechanical vibrations that propagate through or near the structure, so it is passive in that it does not produce acoustic vibrations on its own.

The most obvious applications for an active, passive acoustic device are active acoustic filters and lenses. Active filters are very useful in long range, or high sensitivity imaging applications where minor vibrations cause significant issues with image quality. Since vibrations can be sourced from anything ranging from harmonic frequencies of a carrier plane, to the fans used to cool electronics, an active filter would be able to filter out unwanted vibrations as they are generated externally. Current active filters primarily use transducers and sensors to generate 180° out of phase sound to counteract detected sound or vibrations using complicated electronics. Limitations of this technology are caused by the speed and sensitivity of the detection and generating electronics and the knowledge of the propagating material. The TuPSS filter would require external sensors to detect unwanted vibrations, and a stimuli inducing equipment to modulate the TuPSS, but no complicated electronics would be needed.

Technologies involving acoustics have evolved rapidly over the last decade. The limitations of modifications to the TuPSS design are limited only by the mechanical properties of the materials used to make the structures.

A tunable polymer-based sonic structure can be used in any capacity where a mechanical wave must be actively modulated. An example is utilization of an electrically modulated TuPSS (tunable polymer sonic structure) in an ultrasonic biological imaging system. Most current technologies make use of phased transducer arrays for imaging applications. By utilizing complex computer software and data processing techniques, an array of transducers are pulsed such that constructive interference of the near-field waves occurs at a single point. The phased array focused pulse is limited to <15 cm depth in ideal conditions, operates over a single or very short range of ultrasonic frequencies, can be swept a small area laterally from the optical plane, and requires careful monitoring of equipment settings for acceptable results. Computer software utilizes pulse-delay FFT analysis to reconstruct the reflected sound into images.

A TuPSS would be incorporated either as an extension of the phased array transducers, or as the focusing element with a broadband transducer. The TuPSS is only limited by the design, and can be design to have focal lengths much larger than 15 cm with the same ease as changing the focal lens in standard optical lenses. Incorporated with a phased array, the TuPSS could focus/defocus to depths >15 cm and be used to enhance imaging.

As a standalone focusing element in combination with a broadband transducer, the TuPSS can be designed to focus/defocus multiple broadband ranges of wavelengths based on the physical state of the polymer incorporated into the structure. The TuPSS would focus/defocus the sound produced by the broadband transducer through the external modulation of the polymer. The mechanical vibrations that are focused/defocused then reflected or transmitted would then be detected by either the source or a separate transducer, hydrophone, or microphone before being reconstructed into an image.

Biological ultrasonic imaging is only a small portion of the applicable technologies. Current technologies that use active acoustic modulation are ultrasonic biomedical imaging, sonic focusing for hyperthermic biological stimulation, geophysical mapping and subsurface imaging, active vibration dampening, SONAR, and service sectors including infrastructure, the aircraft industry, environmental, and energy. These technologies make use of either focusing/defocusing sound, vibration dampening, or filtering. TuPPS behaves as a replacement for the element of the technologies that is used to modulate the mechanical vibrations from an external source. A direct application would be the use of a TuPSS as a sound pollution filter in neonatal care to improve survival rates for infants.

TuPSS is also usable as an active, selective, tunable sensitive acoustic filter. Current acoustic filters utilize either dampening materials or active noise cancellation using sensor-response acoustics. Dampening materials are useful because they are relatively inexpensive, can be deployed easily in most applications, and do not require any external equipment to operate. Disadvantages of dampening materials include the inherent need to apply more material to increase effectiveness and the lack of ability to modulate the sensitivity because the limitations are based primarily on the material characteristics. More specifically, since dampening materials get all their dampening properties from their physical characteristics, if a frequency range of mechanical vibrations is not affected by the dampening material, another material must be found and incorporated to maintain dampening properties.

Active sound dampening using sensor-response acoustics uses sensors to detect impinging sound waves and active acoustic components to produce mechanical vibrations that are 180° out of phase in both amplitude and phase. For sound that is travelling through the dampening components, usually speakers or transducers, the opposite out of phase vibrations of the components effectively cancel the sound through destructive absorption. For mechanical vibrations that need to be cancelled at a point away from both the impinging sound source and the neutralizing components, the neutralizing components utilize sensor information to broadcast 180° out of phase sound to achieve destructive interference at some point in space.

Advantages of the active sensor-response sound dampening include the capability to work in any range of frequencies where the equipment can produce sound, the ability to theoretically completely cancel out an external sound, and the broadcast sound cancellation to any point in space. For broadcasting sound cancellation, the extremely high speed, sensitivity, and communication ability of the detecting equipment, paired with the highly detailed knowledge of the material interstitially filling the space between the sound neutralizing source and the desired dampened point, make broadcast sound dampening expensive and difficult to implement in a practical manner. Sensor-response vibration dampening for throughput sound does not require the level of complicated electronics as broadcast cancellation, but requires the element size of the noise cancelling transducer or speaker to be large enough to shield the entire area to be protected from the impinging unwanted sound. For small scale applications, this does not represent an issue as the fabrication of fast reaction transducers up to 3" can be easily accomplished. However, large scale implementation becomes more cost prohibitive as the number of required individual components and electronics increases significantly.

A TuPSS as an active sensitive acoustic filter is almost an intermediary between the two technologies. Standalone phononic crystals can contain complete stop gaps that theoretically prevent the propagation of bandwidths of sound 100%, though in practice the effectiveness is slightly less. The behavior of standalone phononic crystals behaves as almost a combination of active sensor-response noise cancellation and dampening. Phononic crystals can be designed to work in any frequency range as limited by manufacturing techniques, like sensor-response technology, but also can be deployed relatively cheaply over large areas without any necessary external control. However, like dampening materials, once a phononic crystal is fabricated, its properties are fixed so that it will only work in the frequency range for which was designed.

A TuPSS with a phononic crystal standalone filled with polymer would require a stimulus equipment to modulate the polymer. By adding the polymer, the effective range of the phononic crystal can be modified by the changing physical parameters of the polymer. So the TuPSS behaves as a sensor-response technology that can modify its properties as external detectors determine, but still can be deployed on the same scale as a dampening material while not needing complicated electronics. Since the TuPSS could be designed to forbid large bandwidths, the only active component, the tuning equipment, would only need to operate to shift the large bandwidth to cover whatever is necessary.

Regardless of the form, the TuPSS requires three (3) primary components: 1) A polymer with mechanical properties that are sensitive to magnetic, electric, electromagnetic, thermal, chemical, or shaking stimulus; 2) A sonic structure or design to manipulate mechanical waves, also described as a hylemorphic acoustic structure; and 3) Equipment or materials to activate the stimulus.

Example 1

TuPSS as Temperature Sensitive Acoustic Filter

Figure 2:
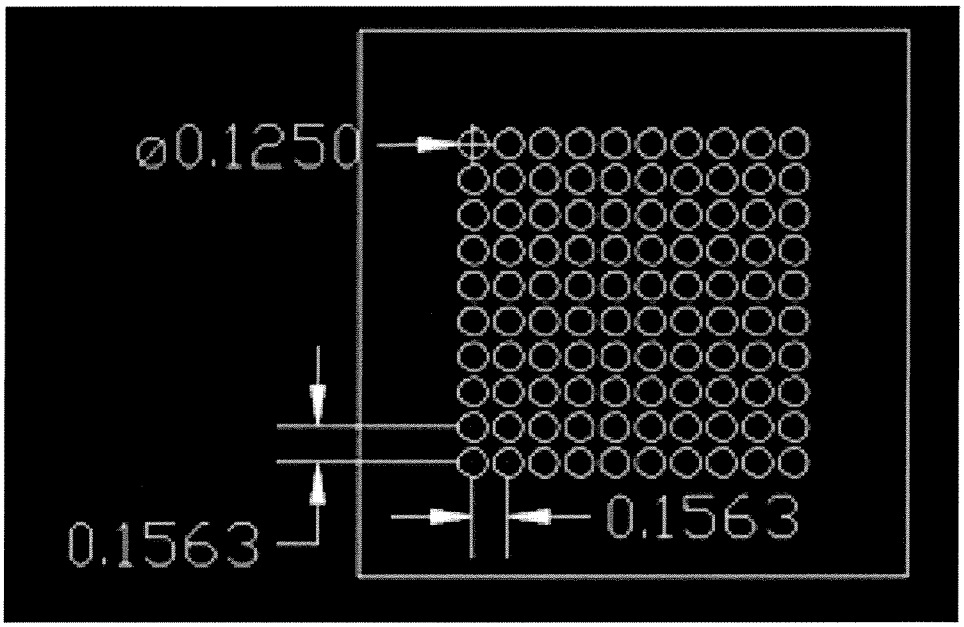
FIG. 2 shows a top view of an embodiment of a TuPSS temperature actuated acoustic filter.
Figure 3:
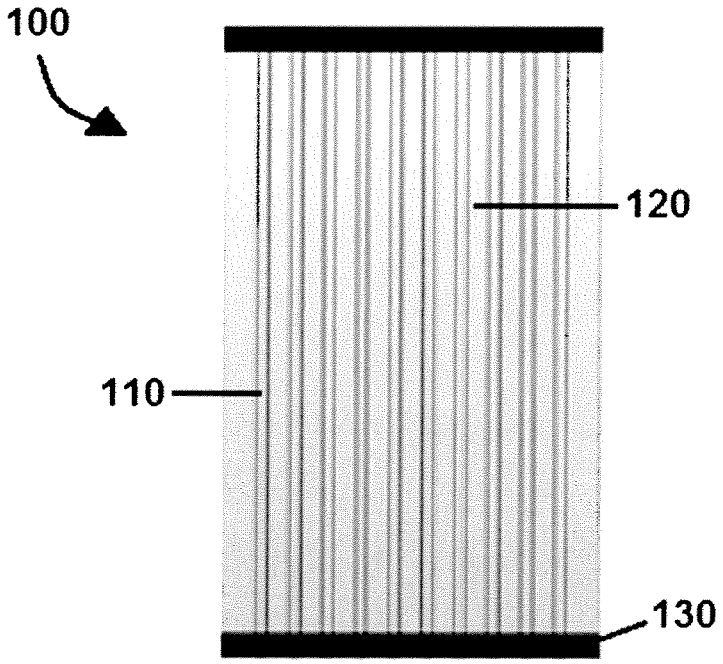
FIG. 3 shows a side view of an embodiment of a TuPSS temperature actuated acoustic filter.
Figure 4:
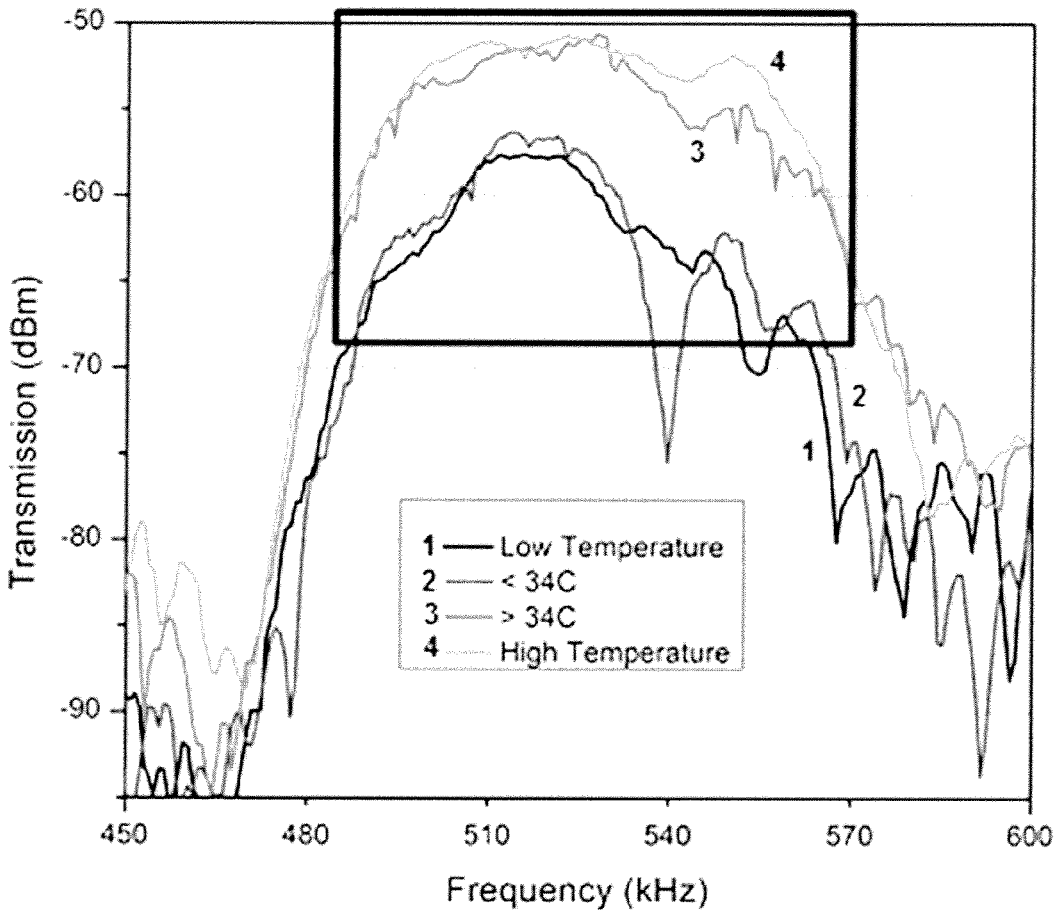
FIG. 4 shows measured transmission data using an embodiment of a TuPSS temperature actuated acoustic filter.

A TuPSS that works as a temperature sensitive acoustic filter at 480-580 kHz is presented. Square stainless steel rods about 6 inches in length are arranged in a square lattice configuration in poly (n-isopropylacrylamide) polymer hydrogel (bulk PNIPAm) formed using free radical polymerization, as shown in FIGS. 2 and 3. FIG. 3 shows a side view of the TuPSS 100, having rods 110 made of stainless steel in a periodic arrangement within polymer 120. The ends 130 of TuPSS are made of acrylic plastic to stabilize the structure. This TuPSS embodiment operates in water, but may also operate in air as long as the structure is hydrated. At temperatures lower than 33° C., it filters out 70% to greater than 90% of a signal in the frequency range of 480-580 kHz (approximately 6 dBm to greater than 10 dBm reduction). The results of the transmission test are shown in FIG. 4. At temperatures above 34° C., no signal extinction is seen. However, at temperatures below 34° C., a temperature signal extinction of about 7 dBm is observed, demonstrating the use of the TuPSS as a temperature sensitive acoustic filter.

The fabrication and measurement procedure are as follows. A square lattice matrix of ⅛" holes spaced 5/32" is milled into two 2"×2"×⅓" thick acrylic slabs. Stainless steel rods ⅛" in diameter and 7" in length are placed into the square lattice matrix such that 6" of rod is spaced between the two acrylic slabs. 6" nylon spacing posts at the corners of the acrylic slabs ensure the spacing remains 6".

Bulk Poly(N-isopropylacrylamide) is polymerized into the interstitial spacing between the rods using free radical polymerization. N-Isopropylacrylamide monomer, N,N'-Methylene-bisacrylamide crosslinker, and DI water are mixed together in a ratio of 0.10 (wt):0.02 (mol NIPA): 0.84 (wt) to make 600 ml of monomer solution. The structure is then placed into the solution. The combination is then set in an ice bath and pumped with $N_2$ for 30+ min. while being magnetically stirred to remove oxygen from the solution. Ammonium Persulfate initiator and N,N,N',N'-Tetramethyl-ethylenediamine accelerator are then added in quantities 0.02 (mol % NIPA) for final polymerization. The polymer-based sonic structure is then rotated through 12 hr. water baths continuously for 48 hrs.

The TuPSS presented is actuated by temperature. Below 33° C., 480-580 kHz transmission is 6 to 10 dBm below transmission that occurs above 33° C. Thus the TuPSS is a thermally activated tunable filter. Verification is done in water at ambient temperature. Resistive heating/convective cooling provide temperature control. Two 1" diameter, 0.5 MHz ultrasonic transducers placed opposite each other with only the TuPSS separating the two operate with one as sound source, and the other as detector. Sweeping from 480-580 kHz and recording detected signal gives the transmission characteristics of the temperature actuated TuPSS structure.

Example 2

TuPSS as Voltage Sensitive Acoustic Lens

To prepare this TuPSS embodiment, an acrylic plastic biconvex acoustic lens having dimensions of $R_1$, $R_2$ each about 45 mm is cut and shaped. An Aluminum Nitride (AlN) nanocrystal polymer composite is formed using the following steps. AlN nanocrystals are formed using the benzene thermal method as described in the work of Yu et. al. Poly(N-vinylcaprolactam) microgels are prepared using the steps described in Boyko et. al's work with AlN nanocrystals added during the emulsification process for proper mixing. The composite forms the polymer nanocrystal. Gold electrodes with leads are attached to the surface of two opposing edges of the lens, although any other suitable metal could be used for the electrodes. A thin polyurethane coating is then applied to the outside of the lens, leaving an open volume between the coating and the lens to be filled with the polymer nanocrystals. The thickness of the nanocrystals is 5 mm between the lens and the coating. After filling the open space with the polymer nanocrystals, the structure is sealed. Actuation of the polymer using a power supply changes the focal length of any transmitted mechanical vibrations through the lens.

Figure 5:
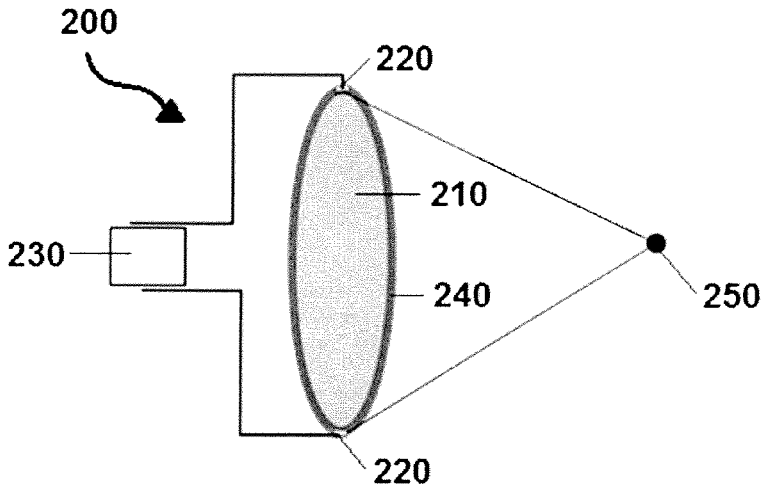
FIG. 5 shows (A) an embodiment of a TuPSS voltage sensitive acoustic lens with an actuated polymer coating and (B) an embodiment of a TuPSS voltage sensitive acoustic lens with a non-actuated polymer coating.
Figure 5:
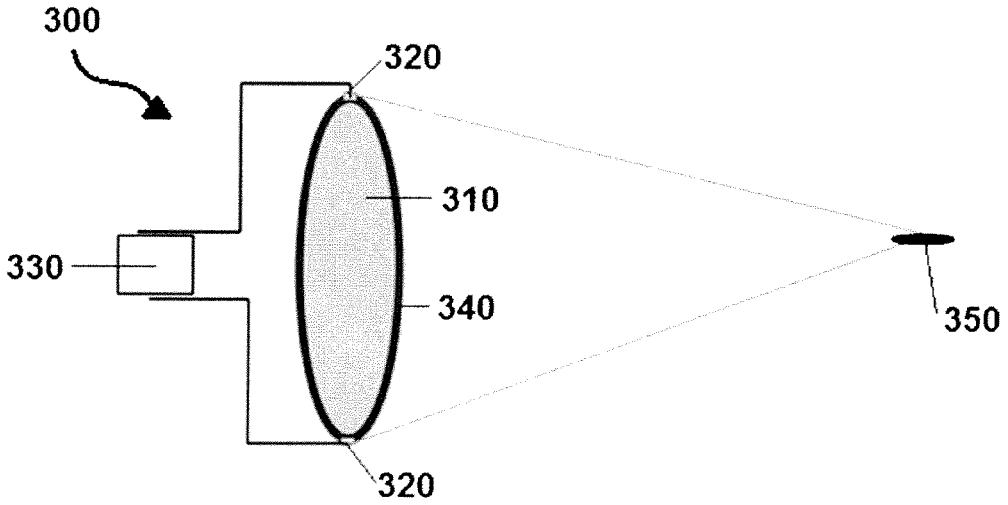

FIG. 5(A) shows the TuPSS 200 made of an acrylic plastic lens 210 and containing electrodes 220 attached to a voltage supply 230 that is on. This TuPSS 200 contains an actuated polymer coating 240 that produces an acoustic focal point 250. FIG. 5(B) shows a similar TuPSS 300 made of an acrylic plastic lens 310 and containing electrodes 320 attached to a voltage supply 330 that is off. This TuPSS 300 contains a non-actuated polymer coating 340 that produces an acoustic focal point 350 that is different from the focal point seen in FIG. 5(B). Thus, this TuPSS embodiment functions as an acoustic lens that can be focused by voltage sensitive actuation.

Example 3

TuPSS as Magnetic Actuation Sensitive Acoustic Resonant Cavity

Figure 6:
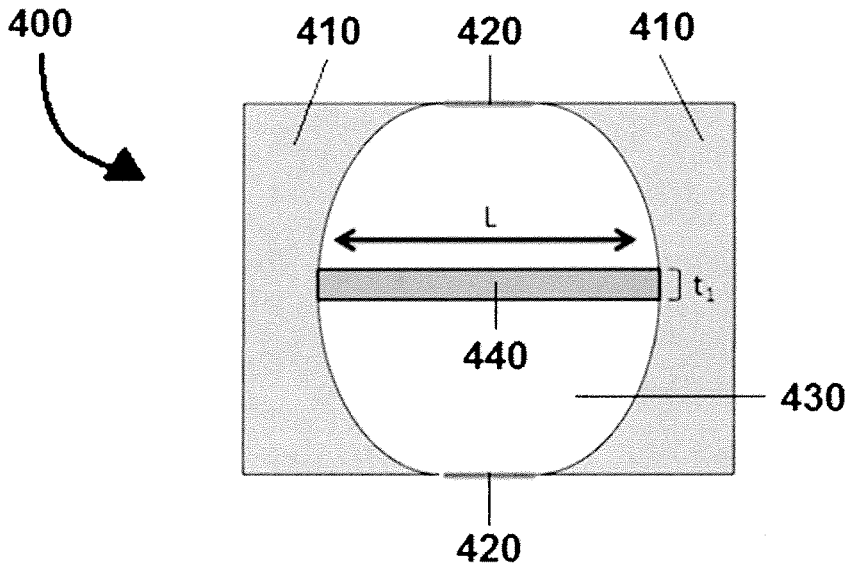
FIG. 6 shows (A) an embodiment of a TuPSS magnetic sensitive acoustic resonant chamber with a non-actuated polymer film and (B) an embodiment of a TuPSS magnetic sensitive acoustic resonant chamber with an actuated polymer film.
Figure 6:
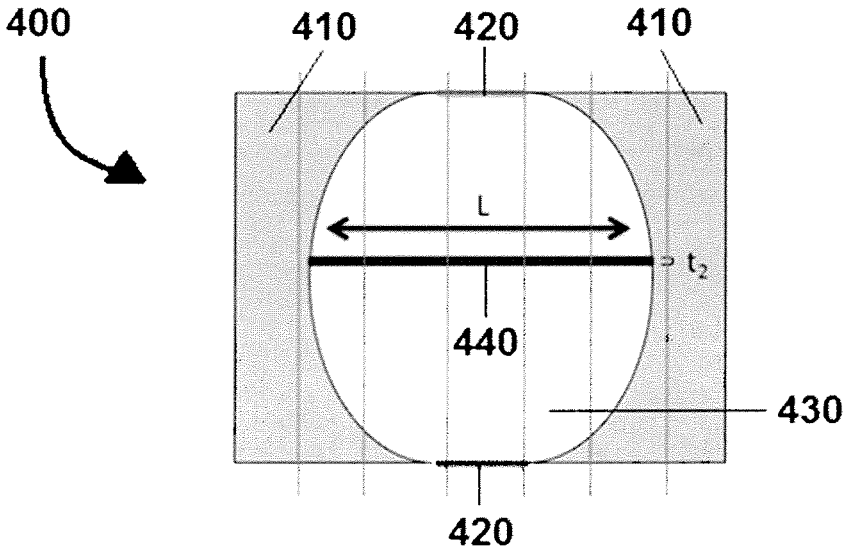

In this example, a TuPSS is prepared as an acoustic resonant cavity that will change its resonant frequency with magnetic actuation. The acoustic resonant cavity is constructed of two plano concave halves (with R equal to 50 cm) using polyamide incorporated aerogel. Sheets of Saran polymer (vinylidene chloride) having a thickness less than 5 mm and a width of about 5 cm are used to connect the two halves to form a concave cavity, as shown in FIG. 6. A thin film is bound to an inner portion of the resonance cavity, made of poly (glycerol monomethacrylate) having 3 wt. % $BiFeO_3$ nanoparticles. The thickness of the film is about 10 mm. The $BiFeO_3$ is formed using the sol-gel technique and the poly (glycerol monomethacrylate) is formed using glycerol monomethacrylate that is cross-linked using the free-radical emulsion technique. The film bisects the cavity into equal halves. Magnetic actuation of the cavity by application of a magnetic field causes the polymer film within the cavity to change thickness, increasing the resonant frequency of the cavity.

FIG. 6(A) shows TuPSS 400 made up of concave halves 410 and polymer sheets 420 to form acoustic resonant cavity 430. The concave halves 410 may be made up of polyamide aerogel. Within TuPSS 400 is a magnetic sensitive polymer film 440 bound to an inner surface of the acoustic resonant cavity 430 so that the film 440 bisects the cavity 430 into approximately equal halves. The magnetic sensitive polymer film may be poly (glycerol monomethacrylate) having $BiFeO_3$ nanoparticles. Length (L) of the film 440 may vary. In FIG. 6(A), no magnetic field is applied to the TuPSS 400 and film 440 has a thickness of $t_1$. FIG. 6(B) shows the same TuPSS 400 as shown in FIG. 6(A). The length L of film 440 is the same as in FIG. 6(A). In FIG. 6(B) a magnetic field is applied to the TuPSS 400 and film 440 has been magnetically actuated to result in a thickness of $t_2$ which is less than that of $t_1$. This magnetic actuation changes the resonant frequency of the acoustic resonant cavity 430 by changing the thickness of the film 440.

REFERENCES CITED

The following documents and publications are hereby incorporated by reference.

OTHER PUBLICATIONS

Berg, R., Stork, G. *The Physics of Sound,* 3rd Ed. New Jersey: Pearson, 2005. Print Boyko, V., Richter, S., Pich, A., Arndt, K.-F., "Poly(N-vinylcaprolactam) microgels. Polymeric stabilization with poly (vinyl alcohol)," *Coilloi Polym. Sci.* 282 (2003) 127-132

Cummer, S., D. Schurig, "One path to acoustic cloaking," *New Journal of Physics* 9 (2007).

Garner, B., T. Cai, S. Ghosh, Z. Hu, and A. Neogi, "Refractive index change due to volume-phase transition in polyacrylamide gel nanospheres for optoelectronics and bio-photonics," *App. Phys. Exp.* 2 (2009).

Goffaux, C., J. Vigneron, "Theoretical study of a tunable phononic band gap system," *Physical Rev. B* 64 (2001).

Hirotsu, S., I. Yamamoto, A. Matsuo, T. Okajima, H. Furukawa, T. Yamamoto, "Brillouin scattering study of the volume phase transition in poly-N-Isopropylacrylamide gels," *Journal of the Physical Society of Japan* 64 (1995).

Khelif, A., P. Deymier, B. Djafari-Rouhani, J. Vasseur, L. Dobrzynski, "Two-dimensional phononic crystal with tunable narrow pass band: Application to a waveguide with selective frequency," *J. of App. Phys.* 94 (2003).

Kushwaha, M., P. Halevi, L. Borzynski, B. Djafari-Rouhani, "Acoustic Band Structure of Periodic Elastic Composites," *Physical Rev. Letters* 71 (1993).

Robillard, J., O. Bou Matar, J. Vasseur, P. Deymier, M. Stippinger, A. Hladky-Hennion, Y. Pennec, B. Djafari-Rouhani, "Tunable magnetoelestic phononic crystals," *App. Phys. Letters* 95 (2009).

Suk-kyun Ahn, et al. Stimuli-responsive polymer gels. *Soft Matter.* 2008. 4. 1151-1157

Tang, H., S. Lee, "Direct experimental verification of the sound-induced tunable resonance on a flexible electrorheological layer," *Journal of App. Phys.* 101 (2007).

Torrent, D., J. Sanchez-Dehesa, "Acoustic cloaking in two dimension: a feasible approach," *New Journal of Physics* 10 (2008).

Wang, J., X. Xu, X. Liu, G. Xu, "A tunable acoustic filter made by periodical structured materials," *App. Phys. Letters* 94 (2009).

Wu, L., M. Wu, L. Chien, "The narrow pass band filter of tunable 1D phononic crystals with a dielectric elastomer layer," *Smart Materials and Structures* 18 (2009).

Yu, M., Hao, X., Cui, D., Wang, Q., Xu, X., Jiang, M., "Synthesis of aluminium nitride nanocrystals and their catalytic effect on the polymerization of benzene," *Nanotechnology* 14 (2003) 29-32.

What is claimed:

1. A tunable polymer-based sonic structure comprising:

a sonic structure engineered to be capable of passively affecting the propagation of sound waves;

a polymer having acousto-elastic properties capable of manipulation through external stimuli, wherein the polymer is in contact with the sonic structure such that the polymer is capable of affecting the propagation of sound waves through the sonic structure; and a source of external stimuli for manipulation of the acousto-elastic properties of the polymer, wherein the sonic structure comprises a plurality of metal rods having stabilizing ends, wherein the polymer comprises poly (n-isopropylacrylamide) polymer hydrogel, wherein the polymer surrounds the plurality of metal rods and is contained within the stabilizing ends of the sonic structure, wherein the source of external stimuli is water having a variable temperature, and wherein the tunable polymer-based sonic structure is a temperature sensitive acoustic filter.

2. The tunable polymer-based sonic structure of claim 1, wherein raising the temperature of the water makes the temperature sensitive acoustic filter capable of filtering out an acoustic signal, and wherein lowering the temperature of the water prevents the temperature sensitive acoustic filter from being capable of filtering out an acoustic signal.

3. A tunable polymer-based sonic structure comprising:

a sonic structure engineered to be capable of passively affecting the propagation of sound waves;

a polymer having acousto-elastic properties capable of manipulation through external stimuli, wherein the polymer is in contact with the sonic structure such that the polymer is capable of affecting the propagation of sound waves through the sonic structure; and a source of external stimuli for manipulation of the acousto-elastic properties of the polymer, wherein the sonic structure comprises a bioconvex acoustic lens, wherein the polymer comprises AlN nanocrystals, wherein the polymer surrounds the bioconvex acoustic lens, wherein the source of external stimuli is a voltage supply, and wherein the tunable polymer-based sonic structure is a voltage sensitive acoustic lens.

4. The tunable polymer-based sonic structure of claim 3, further comprising electrodes attached to the bioconvex acoustic lens and in contact with the polymer.

5. The tunable polymer-based sonic structure of claim 3, wherein applying a voltage to the voltage sensitive acoustic lens changes an acoustic focal point of the voltage sensitive acoustic lens.

6. A tunable polymer-based sonic structure comprising:

a sonic structure engineered to be capable of passively affecting the propagation of sound waves;

a polymer having acousto-elastic properties capable of manipulation through external stimuli, wherein the polymer is in contact with the sonic structure such that the polymer is capable of affecting the propagation of sound waves through the sonic structure; and a source of external stimuli for manipulation of the acousto-elastic properties of the polymer, wherein the sonic structure comprises an acoustic resonant cavity, wherein the polymer comprises poly (glycerol monomethacrylate) and metallic nanoparticles, wherein the polymer is a thin film bound to an inner portion of the acoustic resonant cavity, wherein the source of external stimuli is a magnetic field, and wherein the tunable polymer-based sonic structure is a magnetic actuation sensitive acoustic resonant cavity.

7. The tunable polymer-based sonic structure of claim 6, wherein the metallic nanoparticles are $BiFeO_3$ nanoparticles.

8. The tunable polymer-based sonic structure of claim 6, wherein applying a magnetic field to the magnetic actuation sensitive acoustic resonant cavity changes a resonant frequency of the magnetic actuation sensitive acoustic resonant cavity.

* * * * *